US008070494B2

(12) United States Patent
Li

(10) Patent No.: US 8,070,494 B2
(45) Date of Patent: Dec. 6, 2011

(54) UNIVERSAL CONNECTOR AND ELECTRONIC DEVICE USING THE SAME

(75) Inventor: Jian-Hui Li, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 136 days.

(21) Appl. No.: 12/640,131

(22) Filed: Dec. 17, 2009

(65) Prior Publication Data

US 2011/0053386 A1 Mar. 3, 2011

(30) Foreign Application Priority Data

Sep. 3, 2009 (CN) ..... 2009 1 0306545

(51) Int. Cl.
*H01R 39/00* (2006.01)

(52) U.S. Cl. ..... 439/26

(58) Field of Classification Search ..... 439/26, 439/24, 25, 27–31
See application file for complete search history.

(56) References Cited

U.S. PATENT DOCUMENTS

| | | | | | |
|---|---|---|---|---|---|
| 3,042,998 | A * | 7/1962 | Charles et al. | ..... | 29/597 |
| 3,321,728 | A * | 5/1967 | Cocco et al. | ..... | 439/26 |
| 3,860,312 | A * | 1/1975 | Gordon, Jr. | ..... | 439/31 |
| 4,189,702 | A * | 2/1980 | Maloy | ..... | 367/109 |
| RE32,805 | E * | 12/1988 | Engelmore et al. | ..... | 439/26 |
| 4,850,882 | A * | 7/1989 | Yu | ..... | 439/31 |
| 5,557,975 | A * | 9/1996 | Crane et al. | ..... | 73/862.338 |
| 5,865,629 | A * | 2/1999 | Bernardini | ..... | 439/26 |
| 6,370,020 | B1 * | 4/2002 | Toukairin | ..... | 361/679.22 |
| 6,508,131 | B2 * | 1/2003 | Frick | ..... | 73/756 |
| 6,793,415 | B2 * | 9/2004 | Arbuckle | ..... | 396/427 |
| 7,002,269 | B2 * | 2/2006 | Angerpointer | ..... | 310/68 R |
| 7,094,059 | B2 * | 8/2006 | Obermeyer | ..... | 439/6 |
| 7,719,158 | B2 * | 5/2010 | Angerpointner et al. | ..... | 310/239 |

* cited by examiner

*Primary Examiner* — Neil Abrams
(74) *Attorney, Agent, or Firm* — Altis Law Group, Inc.

(57) ABSTRACT

A connector includes a universal conductor, a first connecting body, and a second connecting body. The first connecting body connects to the conductor, and the second connecting body rotatably connects to the conductor. The present disclosure further discloses an electronic device using the universal connector.

4 Claims, 4 Drawing Sheets

UNIVERSAL CONNECTOR AND ELECTRONIC DEVICE USING THE SAME

BACKGROUND

1. Technical Field

The present disclosure relates to connectors, and particularly, to a universal connector used in an electronic device.

2. Description of Related Art

Many electronic devices include two or more parts that are rotatably connected as well as electronically connected. If a rotation angle between the parts is too large, the cables electronically connecting them may be damaged.

Therefore, there is a room for improvement within the art.

BRIEF DESCRIPTION OF THE DRAWINGS

Many aspects of a universal connector and electronic device using the connector can be better understood with reference to the following drawings. The components in the drawings are not necessarily to scale, the emphasis instead being placed upon clearly illustrating the connector and electronic device using the connector. Moreover, in the drawings, like reference numerals designate corresponding parts throughout the several views.

DETAILED DESCRIPTION OF THE EMBODIMENTS

The present connector is used in electronic devices, such as mobile phones and so on.

Figure 1:
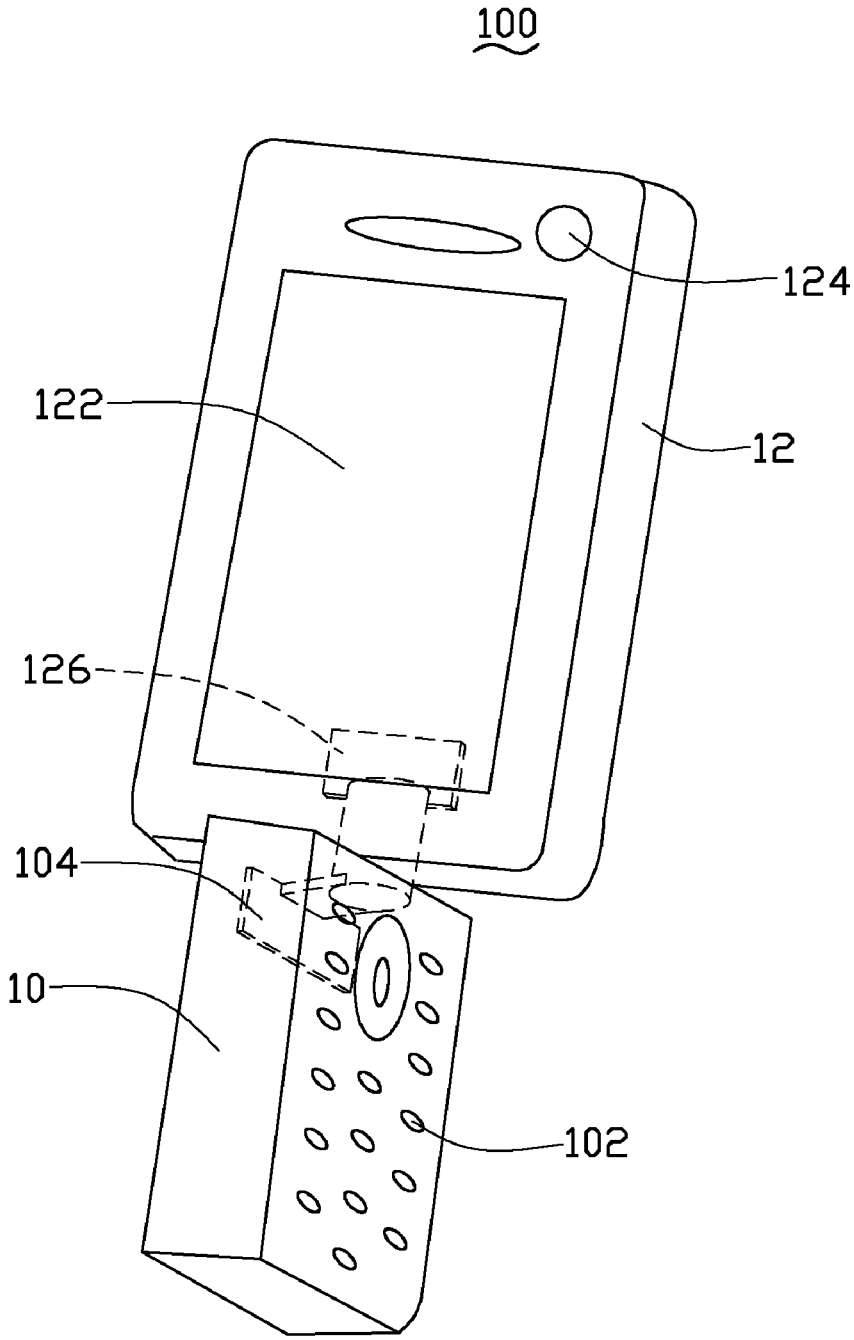
FIG. 1 is an isometric view of an electronic device.

FIG. 1 shows an exemplary electronic device 100 including a first body 10 and a second body 12. The first body 10 and the second body 12 are electrically and rotatably assembled to each other by a universal connector 14 according to a first exemplary embodiment.

Figure 2:
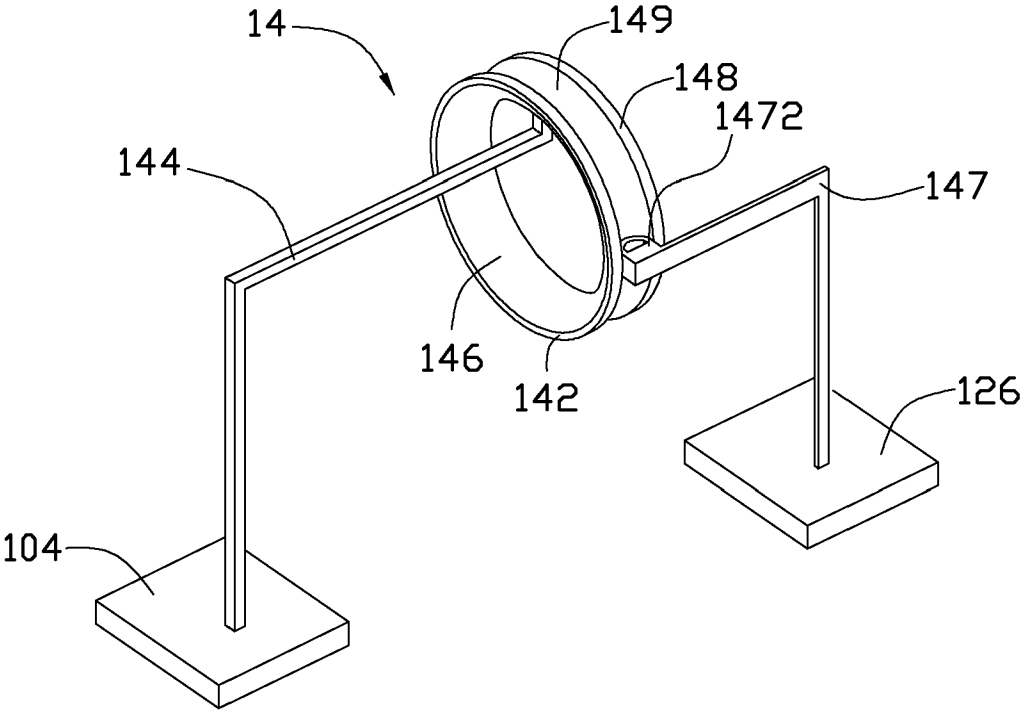
FIG. 2 is an isometric view of a universal connector used in the electronic device of FIG. 1, according to a first exemplary embodiment.

The first body 10 includes a plurality of keys 102 and a first printed circuit board (PCB) 104 shown in FIG. 2. The keys 102 are configured for inputting information. The first printed circuit board 104 is disposed in the first body 10, and is configured for electronically connecting to the connector 14.

The second body 12 includes a display screen 122, a camera 124, and a second printed circuit board 126. The display screen 122 is configured for displaying information or pictures. The camera 124 is configured for taking photos and video. The second printed circuit board 126 is disposed in the second body 12, and is electronically connected to the first printed circuit board 104 by the connector 14.

The connector 14 includes a conductor 142, a first connecting body 144, and a second connecting body 147. The conductor 142 is ring-shaped, and is made of metal, such as copper. The conductor 142 includes an inner peripheral wall 146 and an opposite outer peripheral wall 148. The outer peripheral wall 148 defines an annular recessed guide slot 149. One end of the first connecting body 144 is fixedly and electronically connected to the first printed circuit board 104 and the other end of the first connecting body 144 is slidably and electronically connected to the inner peripheral wall 146. The second connecting body 147 has a protrusion 1472 at one end. In the first exemplary embodiment, the protrusion 1472 is semicircular shape. The protrusion 1472 can slide in the guide slot 149. The other end of the second connecting body 147 electronically connects to the second printed circuit board 126. The first connecting body 144 and the second connecting body 147 can be made of flexible or rigid conductive material. In this exemplary embodiment, the first connecting body 144 and the second connecting body 147 are made of rigid conductive material. With this arrangement although the first connecting body 144 and the second connecting body 147 are fixedly secured to the corresponding first printed circuit board 104 and second circuit board 126 the two circuit boards can freely rotate relative to each other. With this design, the first connecting body 144 and the second connecting body 147 cannot be damaged by over-rotation between the second body 12 and the first body 10.

Figure 3:
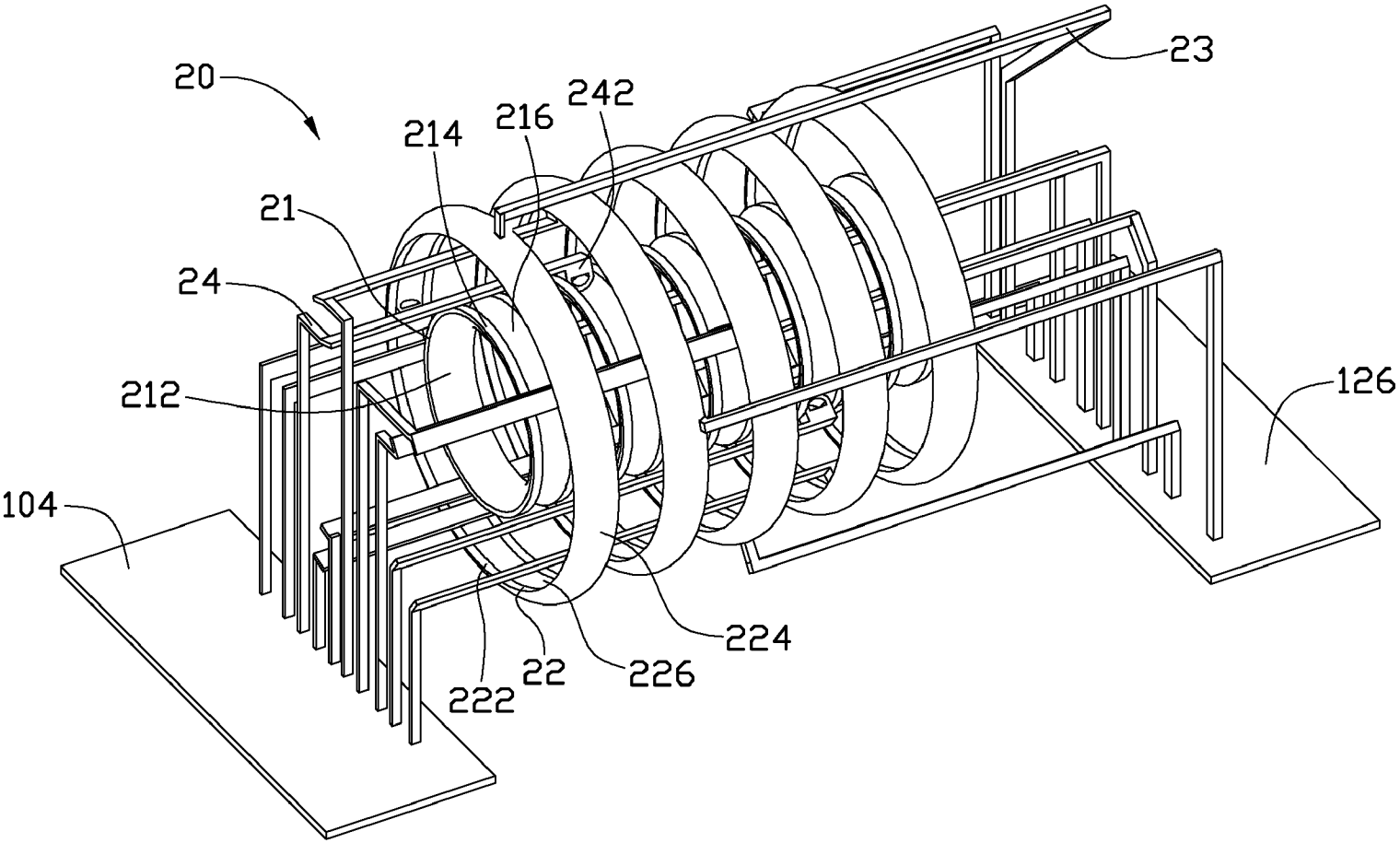
FIG. 3 is an isometric view of a universal connector, according to a second exemplary embodiment.

FIG. 3 shows a second exemplary connector 20 including a plurality of first conductors 21, a plurality of second conductors 22, a plurality of first connecting bodies 23, and a plurality of second connecting bodies 24. The first connecting bodies 23 are connected to the second connecting bodies 24 by the first conductors 21 and the second conductors 22. Each of the first conductors 21 is ring-shaped and includes a first inner peripheral wall 212 and an opposite first outer peripheral wall 214. The first outer peripheral wall 214 defines an annular recessed first guide slot 216. Each of the second conductors 22 is ring-shaped, a diameter of the second conductor 22 is greater than a diameter of the first conductor 21. Each of the second conductors 22 includes second inner peripheral wall 222 and an opposite second outer peripheral wall 224. The second inner peripheral wall 222 defines an annular recessed second guide slot 226. The first connecting bodies 23 are composed of rigid conductive material. The second conductors 22 are coaxial with the first conductors 21. The second connecting bodies 24 have the same structure as the first connecting bodies 23. An end of each of the second connecting bodies 24 has a protrusion 242. In the second exemplary embodiment, the protrusion 242 is semicircular shaped. The first printed circuit board 104 and the second printed circuit board 126 include a plurality of terminals (not shown) corresponding to the first connecting bodies 23 and the second connecting bodies 24. The first connecting bodies 23 and the second connecting bodies 24 electronically connect to the corresponding terminals.

Each second outer peripheral wall 224 of each second conductor 22 is fixedly and electrically connected to one of the first connecting bodies 23. Each first inner peripheral wall 212 of each first conductor 21 is fixedly and electrically connected to others of the first connecting bodies 23. A first group of protrusions 242 rotatably slide within the second guide slots 216 of the first conductors 21. Another group of protrusion 242 rotatably slide within the second guide slots 226 of the second conductors 22. Thus, some of the first connecting bodies 23 and some of the second connecting bodies 24 are electronically connect by the first conductors 21. The other first connecting bodies 23 and the other corresponding second connecting bodies 24 are electronically connected by the second conductors 22. When the second body 12 and the first body 10 are rotated relative to each other, the first printed circuit board 104 remains electronically connected to the second printed circuit board 126 by the connector 20. Thus, the first body 10 and the second body 12 are not limited in angular orientation relative to each other.

Figure 4:
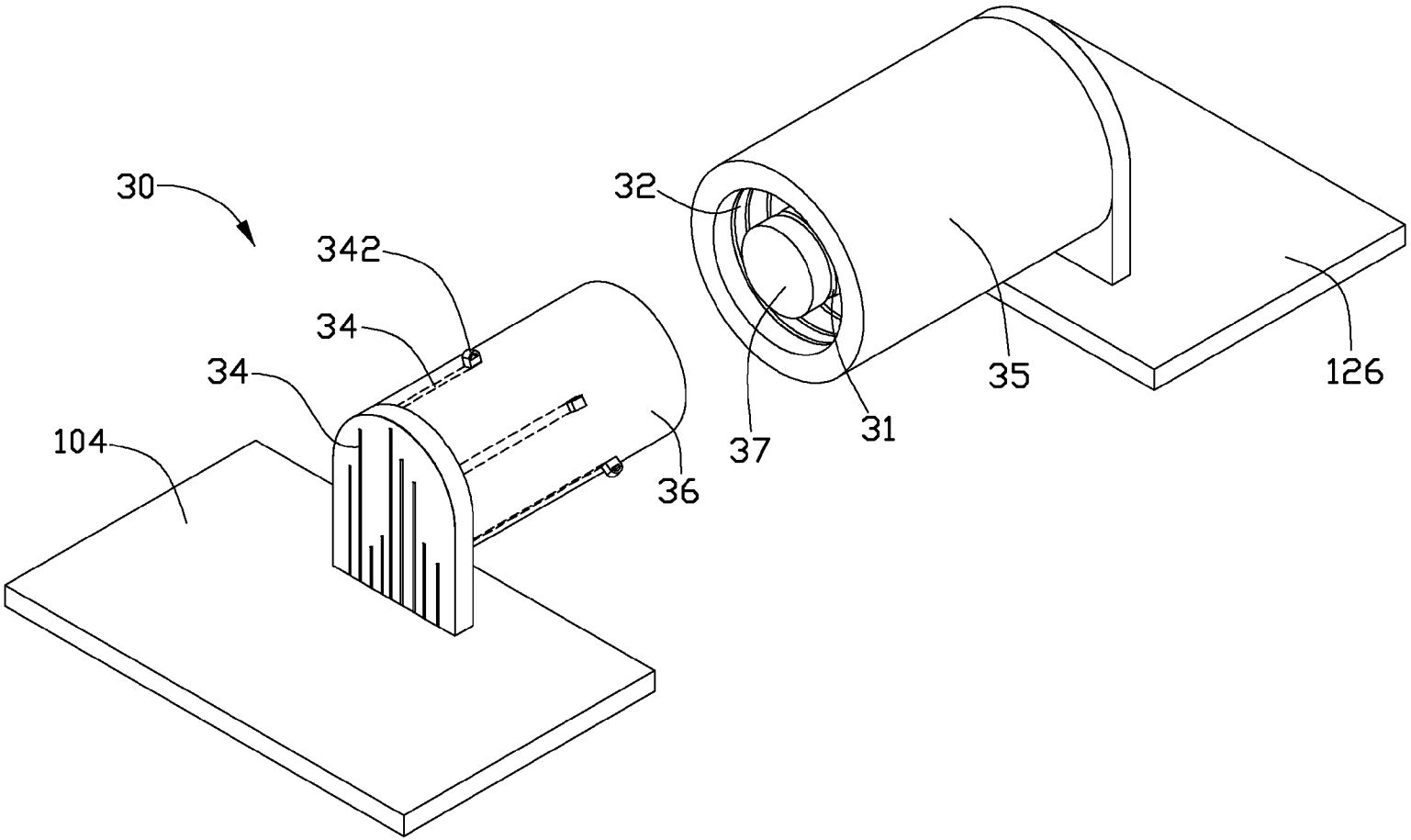
FIG. 4 is an isometric view of a universal connector, according to a third exemplary embodiment.

FIG. 4 shows a third exemplary connector 30 has the same structure as the connector 20 except a plurality of first connecting bodies (not shown) and second connecting bodies 34. The first connecting bodies and the second connecting bodies 34 are flexible wires. In addition, the connector 30 further includes a first sleeve 35, a second sleeve 36, and a post 37 for supporting a first conductor 31 and a second conductor 32. The first sleeve 35, the second sleeve 36, and the post 37 are made of insulating material. An outer peripheral wall of the second conductor 32 and the first connecting bodies are inserted into the first sleeve 35. The second connecting bodies 34 are inserted into the second sleeve 36, and some of the protrusions 342 are exposed from an outer peripheral wall of the second sleeve 36, and the remaining protrusions 342 are exposed from an inner peripheral wall of the second sleeve 36. An inner peripheral wall of the first conductor 31 and the first connecting bodies connecting to the inner peripheral wall of the first conductor 31 are inserted into the post 37. The protrusions 342 exposed from the outer peripheral wall of the second sleeve 36 rotatably electronically connect to the second conductor 32 inserted into the first sleeve 35. The protrusions 342 exposed from an inner peripheral wall of the second sleeve 36 rotatably electronically connect to the first conductor 31 inserted into the post 37. Thus, the first body 10 electronically connects to the second body 12.

The parts of an electronic device using the universal connector can be rotated relative to each through 360 degrees and more without damaging the electronic connection therebetween.

It is to be understood, however, that even through numerous characteristics and advantages of the present disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A universal connector used for electrically connecting to a plurality of terminals positioned on two printed circuit boards, comprising:

a plurality of ring-shaped first conductors;

a plurality of ring-shaped second conductors coaxially placed around the first conductors and spaced from the first conductors;

a plurality of first connecting bodies, an end of the first connecting bodies connected to the terminals positioned on one of the printed circuit boards, the other end of the first connecting bodies fixedly connected to the first conductors or the second conductors;

a plurality of second connecting bodies, the first connecting bodies and the second connecting bodies made of rigid conductive material and supporting the first conductors and the second conductors; an end of the second connecting bodies connecting to the terminals positioned on the other of the printed circuit boards; the other end of the second connecting bodies rotatably connected to the first conductors or the second conductors.

2. The universal connector as claimed in claim 1, wherein a part of the first connecting bodies electrically connected to the first conductors; another part of the first connecting bodies electrically connected to the second conductors; a part of the second connecting bodies electrically connected to the second conductors; another part of the second connecting bodies rotatably connected to the first conductors.

3. The universal connector as claimed in claim 2, wherein the first conductors and the second conductors respectively define a guide slot; an inner peripheral wall of the first conductors and an outer peripheral wall of the second conductors connect to corresponding the first connecting bodies; a part of the second connecting bodies rotatably connected to and slides within the guide slot of the first conductors, another part of the second connecting bodies rotatably connected to and slides within the guide slot of the second conductors.

4. The universal connector as claimed in claim 3, wherein the second connecting bodies respectively includes a protrusion rotatably connecting to the guide slot of the first conductors and the second conductors.

* * * * *